US006611086B2

(12) United States Patent
Inoue et al.

(10) Patent No.: US 6,611,086 B2
(45) Date of Patent: Aug. 26, 2003

(54) LIGHT SOURCE BULB FOR HEAD LAMP

(75) Inventors: Akihito Inoue, Isehara (JP); Yasuhiro Okubo, Isehara (JP)

(73) Assignee: Ichikoh Industries Ltd., Tokyo (JP)

( * ) Notice: Subject to any disclaimer, the term of this patent is extended or adjusted under 35 U.S.C. 154(b) by 13 days.

(21) Appl. No.: 09/934,527

(22) Filed: Aug. 23, 2001

(65) Prior Publication Data

US 2002/0024819 A1 Feb. 28, 2002

(30) Foreign Application Priority Data

Aug. 31, 2000 (JP) ..... 2000-263811

(51) Int. Cl.[7] ..... H01K 9/08

(52) U.S. Cl. ..... 313/272; 313/113; 362/538; 362/213

(58) Field of Search ..... 313/113, 115, 313/243, 271, 272, 277; 362/538, 539, 508, 211, 212, 213

(56) References Cited

U.S. PATENT DOCUMENTS 6,271,622 B1 * 8/2001 Coushaine et al. ..... 313/272

FOREIGN PATENT DOCUMENTS

JP 2000-164021 6/2000

* cited by examiner

*Primary Examiner*—Sandra O'Shea
*Assistant Examiner*—John Anthony Ward
(74) *Attorney, Agent, or Firm*—Foley & Lardner

(57) ABSTRACT

In first to third support wires (12, 13, 14) connected to a low beam filament L and a high beam filament H, which are arranged in the light source bulb 9, a bent portion 13*a* is formed by bending the second support wire 13 from a curved portion 13*c* towards the first support wire at an obtuse angle θ2, and each rear lead Lb, Hb of the low beam filament L and the high beam filament H is connected to the bent portion 13*a*.

Moreover, a bent portion 14*a* is provided by bending the third support wire 14 from a curved portion 14*c* towards the second support wire at an obtuse angle θ3, and a front lead Ha of the high beam filament H is connected to the bent portion 14*a*.

The extended portions 13*b* and 14*b* of the second support wire 13 and the third support wire 14 are inclined at an obtuse angle θ4, θ5, respectively.

7 Claims, 4 Drawing Sheets

LIGHT SOURCE BULB FOR HEAD LAMP

BACKGROUND OF THE INVENTION

1. Field of the Invention

The present invention relates to a double-filament type light source bulb for head lamp, comprising a low beam filament and a high beam filament.

2. Description of the Related Art

As the related art of the light source bulb for head lamp, there can be mentioned Japanese Patent Application Laid-Open No. 2000-164021. In the related art, the light source bulb is a double filament type comprising a low beam filament and a high beam filament in a glass bulb, the low beam filament being connected to first and second support wires, and the high beam filament being connected to second and third support wires.

By rotating the light source bulb, it becomes possible to have a light distribution pattern for the left-hand traffic classification like in Japan, and a light distribution pattern for the right-hand traffic classification in overseas (USA and the like). In either of the distribution pattern, when the low beam filament is lighted, the bottom end becomes the cut line (lighting border plane). Therefore, in the space at the rear of the low beam filament, a virtual image glare light appears in the portion where it becomes dark originally. In order to avoid this phenomenon, the second support wire supporting the low beam filament is bent in an acute angle en route. Since the second support wire is formed of molybdenum material, if it is acutely bent, the elongation percentage differs largely between the inside and the outside in the bent portion. Therefore, needle-shaped bodies are generated on the outside surface, and a finely split condition likely occurs. If such a condition occurs, not only the strength of the second support wire decreases, but also the needle-shaped bodies fall into the glass bulb, causing a problem in that an electrically adverse effect may be caused in the glass bulb.

Moreover, the point of the third support wire is bent towards the inner surface of the glass bulb. Therefore, in the production of the light source bulb, when the third support wire assembled with the high beam filament or the like in advance is inserted into the glass bulb, the bent edge portion may scratch and damage the inner surface of the glass bulb. If a fine damage due to this scratch of the edge occurs in the glass bulb, there is another problem in that the strength of the glass bulb decreases.

SUMMARY OF THE INVENTION

It is an object of the present invention to provide a light source bulb for head lamp that prevents the "finely split phenomenon" in the second support wire, and to provide a light source bulb for head lamp that prevents scratch due to the edge of the third support wire.

According to a first aspect of the present invention, there is provided a light source bulb for head lamp used in combination with a reflector, and comprising, in a glass bulb, a low beam filament having the filament axis below the central axis of the glass bulb, and having a front lead and a rear lead, a high beam filament having the filament axis at the obliquely lower side of the filament axis of the low beam filament, and having a front lead and a rear lead, and first to third support wires extending from a bridge to the inside of the glass bulb and located at different vertical positions, the front lead of the low beam filament being connected to the front edge of the first support wire located at a high position, each rear lead of the low beam filament and the high beam filament being connected to the front edge of the second support wire located at the central position, respectively, and the front lead of the high beam filament being connected to the front edge of the third support wire located at a low position, wherein at a curved portion on the extended portion of the second support wire extending from the bridge, a bent portion bent towards the first support wire at an obtuse angle is formed, and each rear lead of the low beam filament and the high beam filament is connected to the bent portion.

According to the first aspect of the present invention, since the bent portion of the second support wire is bent so as to form an obtuse angle, finely split needle-shaped bodies are not generated, unlike the conventional case where it is bent at an acute angle. Moreover, since the bent direction is made to be an obtuse angle with respect to the direction of the first support wire, the bent portion does not intrude into the rear space of the low beam filament where it is optically disadvantageous.

Moreover, the second support wire is arranged towards the third support wire. According to the present invention, since the second support wire is arranged towards the third support wire, the second support wire is away from the first support wire, and even if the bent portion of the second support wire is bent toward the first support wire, it does not come too close to the first support wire, and therefore, the first support wire and the second support wire do not electrically interfere with each other.

The extended portion of the second support wire extending forward from the bridge is inclined at an obtuse angle towards the third support wire. As a result, since the portion of the second support wire extending forward from the bridge is inclined at an obtuse angle towards the third support wire, the bent portion of the second support wire does not come too close to the first support wire, further, and the positions of these support wires can be maintained favorably so that electrical interference does not occur between these wires. The rear lead of the high beam filament can be also fixed to the bent portion with the shortest distance.

A bent portion is also formed towards the second support wire at an obtuse angle, at a curved portion on the extended portion of the third support wire extending from the bridge, and the front lead of the high beam filament is connected to the bent portion. According to this, since the bent portion of the third support wire is directed towards the second support wire at an obtuse angle, when the third support wire is inserted into the glass bulb, the third support wire does not damage the inner surface of the glass bulb, even if it touches the inner surface.

Moreover, the extended portion of the third support wire extending forward from the bridge is inclined at an obtuse angle in the opposite direction to the second support wire.

According to this, since the extended portion of the third support wire extending forward from the bridge is inclined at an obtuse angle in the opposite direction to the second support wire, the bent portion at the front edge of the third support wire does not come too close to the second support wire, and these support wires can be maintained in positions which do not electrically interfere with each other.

DETAILED DESCRIPTION OF THE PREFERRED EMBODIMENT

Hereinafter, preferred embodiment of the present invention will be described with reference to FIGS. 1 to 4.

Figure 1:
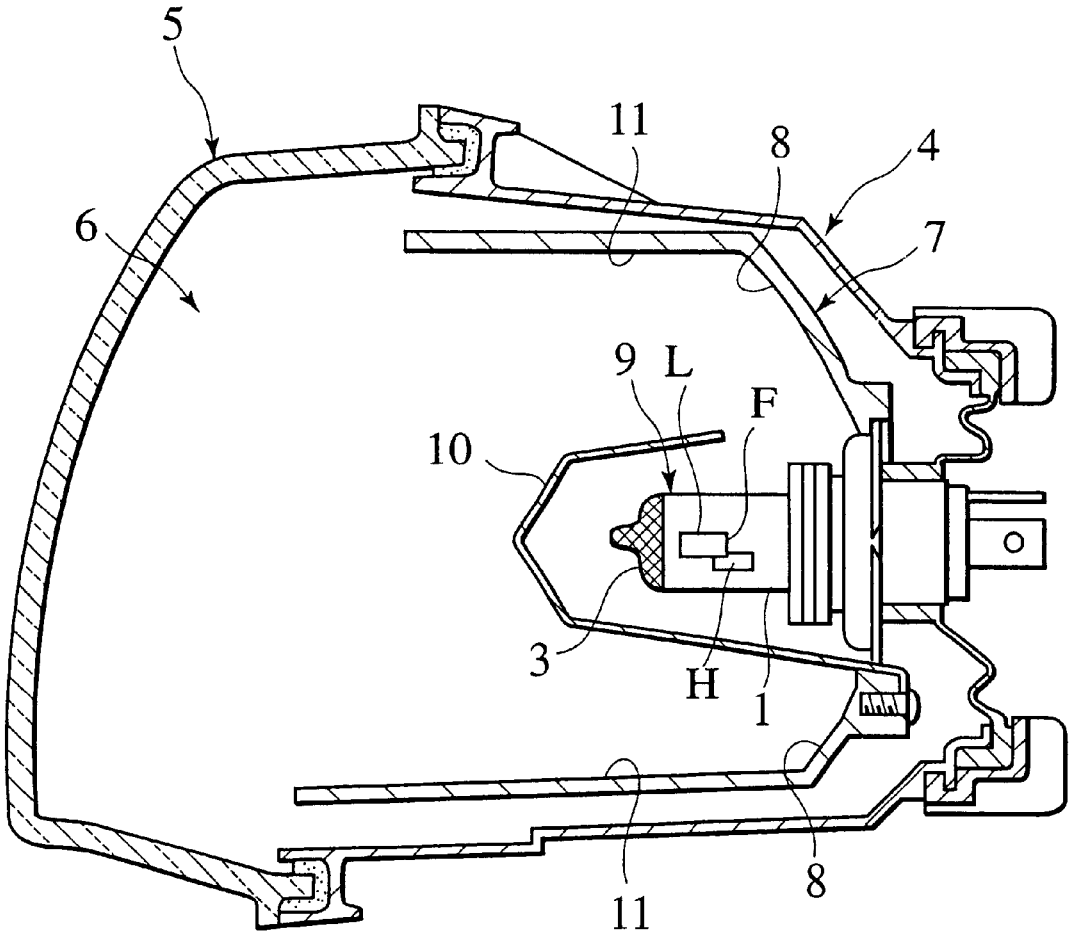
FIG. 1 is a sectional view showing a head lamp according to one embodiment of the present invention.
Figure 2:
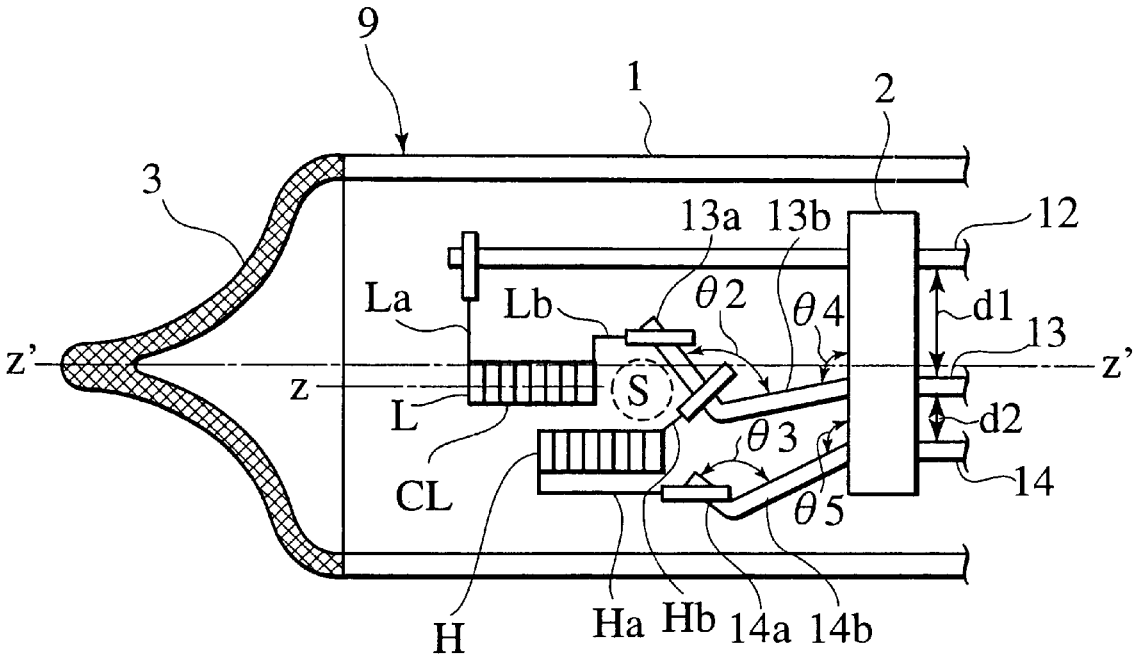
FIG. 2 is a sectional view showing a light source bulb in FIG. 1.

This embodiment relates to a head lamp of vehicles. In this head lamp, a lamp chamber 6 is formed by a lamp housing 4 and an outer lens 5. In this lamp housing 6, a reflector 7 separate from the lamp housing 4 is arranged rotatably in the vertical and horizontal directions, by means of a pivot mechanism (not shown) and an optical axis adjusting mechanism (not shown) and the like. This reflector 7 has a reflecting surface 8 constituted of a composite reflecting surface, referred to as a free-form surface. F in FIG. 1 shows a focal point of the reflecting surface 8 of the reflector 7.

To this reflector 7 is attached a light source bulb 9 detachably, and this light source bulb 9 is a type without a shielding hood, and a low beam filament L and a high beam filament H are arranged in a glass bulb 1. The low beam filament L has a front lead La and a rear lead Lb, and the filament axis below the central axis Z'—Z' of the glass bulb 1. The high beam filament H has a front lead Ha and a rear lead Hb, with the filament axis arranged at the obliquely lower side of the filament axis of the low beam filament L.

A black top 3 is applied to the point of the glass bulb 1 by a black paint.

The central axis Z—Z of the low beam filament L is located below the central axis Z'—Z' of the glass bulb 1. The reason why the central axis Z—Z of the low beam filament L is located below the central axis Z'—Z' of the glass bulb 1 is to obtain a stable cut line (lighting border line) CL in the light distribution pattern of the low beam. In other words, by shifting the central axis Z—Z of the low beam filament L downward than the central axis Z'—Z' of the glass bulb 1, the focused image (virtual image) of the reflected light in the inside portion of the glass bulb 1 does not appear above the cut line CL in the light distribution pattern of the low beam.

A shade 10 is secured to the reflector 7 and covers the front of the light source bulb 9 so as to hinder the direct light from the low beam filament L and the high beam filament H from reaching a reactive portion 11 of the reflector 7 or the outer lens 5.

In the above head lamp using the reflector 7 having the reflecting surface 8 constituted of the above complex reflecting surface, and the light source bulb 9 having the low beam filament L and the high beam filament H, when the low beam filament L is lighted, the light from this low beam filament L is reflected over the whole surface of the reflecting surface 8, and the reflected light is irradiated in the predetermined light distribution pattern of the low beam, through the outer lens 5.

On the other hand, when the high beam filament H is lighted, the light from this high beam filament H is reflected over the whole surface of the reflecting surface 8, and the reflected light is irradiated in the predetermined light distribution pattern of the high beam, through the outer lens 5.

Here, the "predetermined light distribution pattern" stands for the light distribution pattern in conformity with the light distribution standard, such as the European Light Distribution Standard (ECEReg.), or the one corresponding thereto (for example, Japanese Domestic Pattern Approval Standard), and FMVSS in the North America light distribution standard.

Figure 3A:
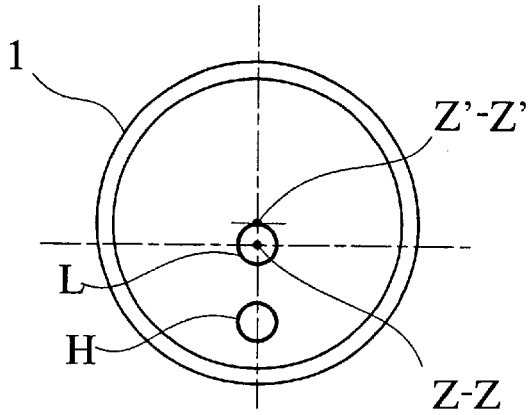
FIG. 3A is a layout drawing showing the arrangement of a low beam filament and a high beam filament in a light source bulb, showing switchover for the left-hand traffic classification and the right-hand traffic classification by means of the rotation of the light source bulb, and 3A shows the neutral state.
Figure 3B:
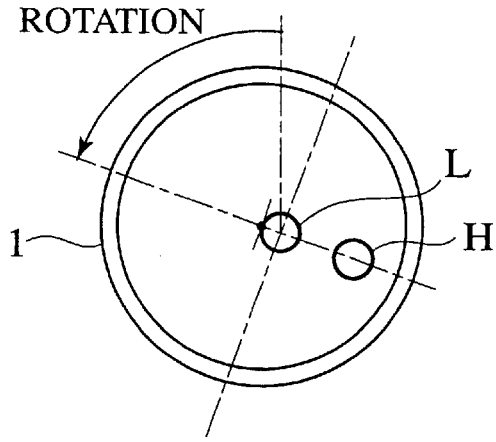
FIG. 3B is a layout drawing of the low beam filament and the high beam filament, in which the light source bulb is rotated from the state in FIG. 3A to the light distribution state for the left-hand traffic classification.
Figure 3C:
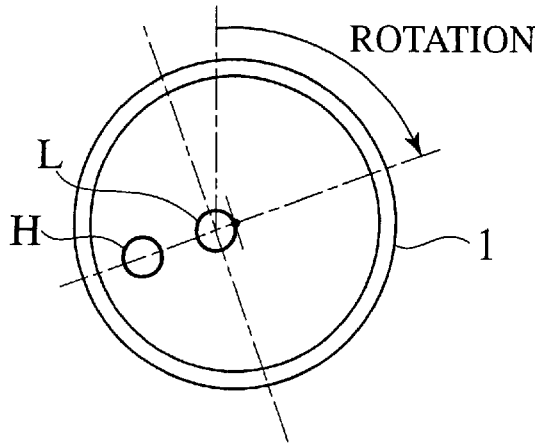
FIG. 3C is a layout drawing of the low beam filament and the high beam filament, in which the light source bulb is rotated from the state in FIG. 3A to the light distribution state for the right-hand traffic classification.

This light source bulb 9 can obtain the light distribution pattern of the low beam and the high beam both for the left-hand traffic classification and for the right-hand traffic classification. In other words, in the left-hand traffic classification where vehicles are driven in the left lane like in Japan, it is necessary to reliably confirm pedestrians who are near the edge of a road in the same left lane, without dazzling the pedestrians, and without giving dazzling light to the car running in the opposite lane, and on the contrary, for the right-hand traffic classification, it is necessary to perform the opposite thing. Therefore, in this light source bulb 9, as shown in FIGS. 3A to 3C, the low beam filament L and the high beam filament H are arranged in the radial direction from the central axis Z'—Z' of the glass bulb 1. If the light source bulb 9 is rotated from the neutral state shown in FIG. 3A towards the left, about the central axis Z—Z of the low beam filament L, it becomes for the left-hand traffic classification shown in FIG. 3B, and if rotated towards the right, it becomes for the right-hand traffic classification shown in FIG. 3C. In this manner, only by rotating one light source bulb 9 to the left and right, the light distribution pattern for both the left-hand traffic classification and the right-hand traffic classification can be obtained, respectively.

Figure 4:
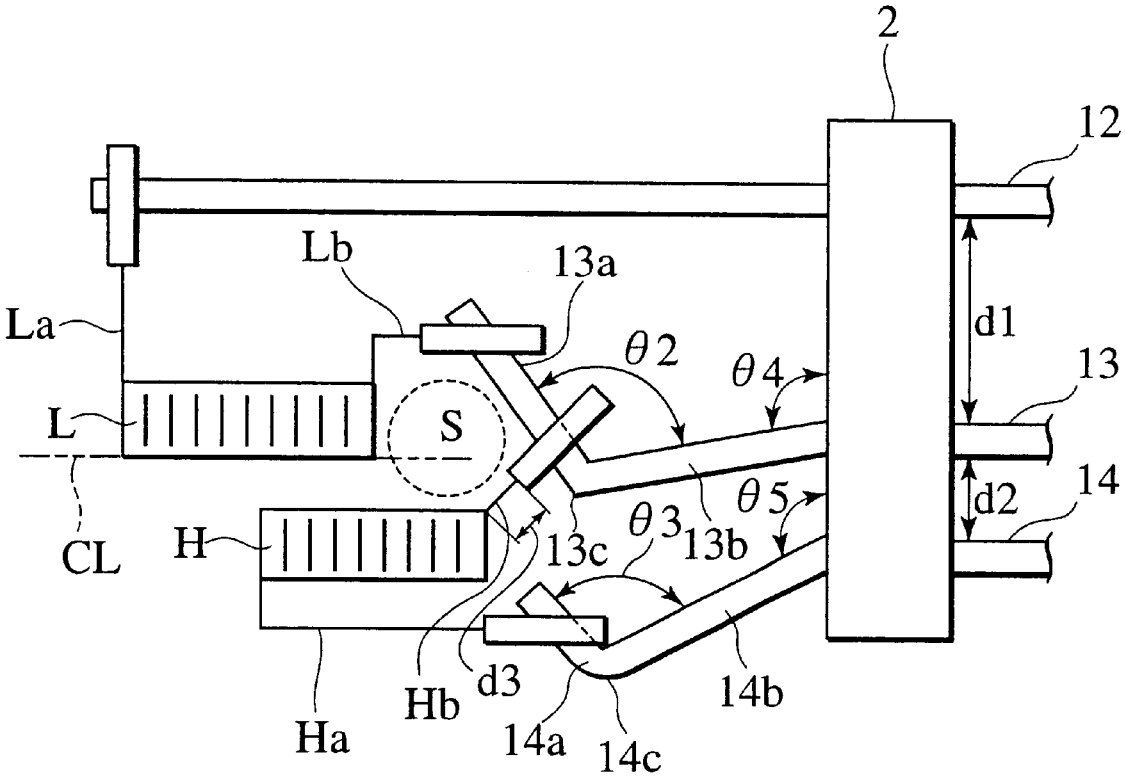
FIG. 4 is an enlarged diagram showing the connection structure of the low beam filament and the high beam filament in FIG. 2 with each support wire.

Next, the connection structure of the low beam filament L and the high beam filament H with the first to third support wires 12, 13, 14, which is the feature of the present invention, will now be described with reference to FIG. 4. The first support wire 12 extends straight from the bridge 2 towards the inside of the glass bulb 1, and the front lead La of the low beam filament L is connected to the front end thereof.

The second support wire 13 is arranged between the first support wire 12 and the third support wire 14, and located towards the third support wire 14 in the bridge 2, and away from the first support wire 12. In other words, in the comparison of the distance d1 between the first support wire 12 and the second support wire 13 with the distance d2 between the second support wire 13 and the third support wire 14, d2 is smaller than d1.

This second support wire 13 has an extended portion 13*b* extending from the bridge 2 towards the inside of the glass bulb 1, and this extended portion 13*b* inclines toward the third support wire at an obtuse angle θ4 (hereinafter, the obtuse angle represents an angle in the range of $90° < \theta < 180°$). This second support wire 13 has a bent portion 13*a*, formed by bending the extended portion 13*b* extending from the bridge 2 towards the first support wire at a curved portion 13*c*, at an obtuse angle θ2. To this bent portion 13*a* are connected each rear lead Lb, Hb of the low beam filament L and the high beam filament H.

The third support wire 14 has also an extended portion 14*b* extending from the bridge 2 towards the inside of the glass bulb 1, similar to the second support wire 13, and this extended portion 14*b* inclines to the direction opposite to the second support wire at an obtuse angle θ5. This third support wire 14 has a bent portion 14*a,* formed by bending the extended portion 14*b* extending from the bridge 2 towards the second support wire at a curved portion 14*c,* at an obtuse angle θ3. To this bent portion 14*a* is connected the front lead Ha of the high beam filament H in a state passing right under the high beam filament H.

As described above, since the bent portion 13*a* of the second support wire 13 is bent at the obtuse angle θ2, finely split needle-shaped bodies are not generated, unlike the conventional case where it is bent at an acute angle. Therefore, the strength of the second support wire 13 is not decreased, nor fall the finely split needle-shaped bodies onto the inner surface of the glass bulb 1 to cause an electrically adverse effect. Moreover, even if the bent portion 13*a* is formed with such an obtuse angle θ2, since the bent portion 13*a* is directed towards the first support wire, the bent portion 13*a* does not intrude into the rear space S of the low beam filament L where it is optically disadvantageous.

Moreover, even if the bent portion 13*a* of the second support wire 13 is formed by bending it towards the first support wire, the second support wire 13 is arranged towards the third support wire 14, and away from the first support wire 12. Therefore, the bent portion 13*a* does not come too close to the first support wire 12, and the first support wire 12 and the second support wire 13 do not electrically interfere with each other. Furthermore, it contributes to keep the positions so as not to cause an electrical contact between the bent portion 13*a* of the second support wire and the first support wire 12, that the extended portion 13*b* of the second support wire 13 inclines from the bridge 2 towards the third support wire at the obtuse angle θ4.

The rear lead Hb of the high beam filament H and the bent portion 13*a* can be connected with the distance d3 between these being shortest.

In this embodiment, since the bent portion 14*a* of the third support wire 14 is also bent towards the second support wire at the obtuse angle θ3, when the third support wire 14 is inserted into the glass bulb 1, the point of the bent portion 14*a* does not damage the inner surface of the glass bulb 1. The bent portion 14*c* comes into contact with the inner surface of the glass bulb 1, but since this bent portion 14*c* has a curved surface, the inner surface of the glass bulb 1 is not damaged. As a result, the strength of the glass bulb 1 is not decreased.

Furthermore, since the extended portion 14*b* of the third support wire 14 is inclined from the bridge 2 towards the direction opposite to the second support wire at the obtuse angle θ5, even if the second support wire 13 inclines towards the third support wire, as described above, the bent portion 14*a* of the third support wire 14 does not come too close to the second support wire, and therefore, the second support wire 13 and the third support wire 14 do not electrically interfere with each other.

What is claimed is:

1. A light source bulb for a head lamp comprising:

a reflector;

a glass bulb attachable and detachable to/from the reflector;

a low beam filament having a filament axis below a central axis of the glass bulb, and a front lead and a rear lead;

a high beam filament having a filament axis at the obliquely lower side of the filament axis of the low beam filament, and a front lead and a rear lead;

first, second and third support wires connected to the low beam filament or high beam filament; and a bridge for securing the first, second and third support wires; wherein, the first, second and third support wires having an extended portion extending from the bridge into the glass bulb, respectively, and arranged at positions having different vertical relations with each other, the front lead of the low beam filament being connected to a front edge of the first support wire located at a high position, the rear lead of the low beam filament and the rear lead of the high beam filament being connected to a front edge of the second support wire located at a central position, respectively, and the front lead of the high beam filament being connected to a front edge of the third support wire located at a low position, and wherein from a curved portion of the second support wire on the extended portion thereof extending from the bridge, a bent portion bent towards the first support wire is formed, an angle between the bent portion and the extended portion of the second support wire is an obtuse angle, and the rear lead of the low beam filament and the rear lead of the high beam filament are connected to the bent portion.

2. The light source bulb for a head lamp of claim 1, wherein a first distance between the extended portion of the second support wire and the extended portion of the third support wire at the bridge is shorter than a second distance of the extended portion of the second support wire and the extended portion of the first support wire at the bridge.

3. The light source bulb for a head lamp of claim 1, wherein an angle between the extended portion of the second support wire extending from the bridge into the glass bulb and the bridge is an obtuse angle, and the extended portion of the second support wire extending from the bridge into the glass bulb is inclined towards the third support wire.

4. The light source bulb for a head lamp of claim 1, wherein the third support wire forms a bent portion forming an obtuse angle towards the second support wire from a curved portion thereof on the extended portion extending from the bridge, and the front lead of the high beam filament is connected to the bent portion of the third support wire.

5. The light source bulb for a head lamp of claim 4, wherein the extended portion of the third support wire extending from the bridge into the glass bulb is inclined at an obtuse angle in the opposite direction to the second support wire.

6. The light source bulb for a head lamp of claim 4, wherein the bent portion of the third support wire is formed so as to have a curved surface.

7. The light source bulb of claim 3, wherein the rear lead of the high beam filament and the bent portion of the second support wire are connected with the shortest distance.

* * * * *